US009124073B2

(12) United States Patent
Yoshida et al.

(10) Patent No.: US 9,124,073 B2
(45) Date of Patent: Sep. 1, 2015

(54) SPARK PLUG

(75) Inventors: Haruki Yoshida, Tajimi (JP); Takamitsu Mizuno, Hashima (JP); Atsushi Tsukada, Yokkaichi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 13/983,073

(22) PCT Filed: Feb. 1, 2012

(86) PCT No.: PCT/JP2012/000687

§ 371 (c)(1),
(2), (4) Date: Aug. 1, 2013

(87) PCT Pub. No.: WO2012/105255

PCT Pub. Date: Aug. 9, 2012

(65) Prior Publication Data

US 2013/0307402 A1 Nov. 21, 2013

(30) Foreign Application Priority Data

Feb. 2, 2011 (JP) ..... 2011-020954

(51) Int. Cl.
*H01T 13/20* (2006.01)
*H01T 13/05* (2006.01)
*H01T 13/34* (2006.01)

(52) U.S. Cl.
CPC ..... *H01T 13/20* (2013.01); *H01T 13/05* (2013.01); *H01T 13/34* (2013.01)

(58) Field of Classification Search
CPC ..... H01T 13/20; H01T 13/34
USPC ..... 313/141
See application file for complete search history.

(56) References Cited

U.S. PATENT DOCUMENTS 6,191,525 B1 * 2/2001 Tanaka et al. ..... 313/141
6,864,622 B2 * 3/2005 Matsutani et al. ..... 313/141

(Continued)

FOREIGN PATENT DOCUMENTS

JP 48-44701 12/1973 ..... H01T 13/36
JP 2-165587 6/1990 ..... H01T 13/20

(Continued)

OTHER PUBLICATIONS

Form PCT/ISA/210—Int'l Search Report (from corresponding Int'l Patent App. No. PCT/JP2012/000687—1 page.

*Primary Examiner* — Nimeshkumar Patel
*Assistant Examiner* — Jacob R Stern
(74) *Attorney, Agent, or Firm* — Kusner & Jaffe

(57) ABSTRACT

A spark plug, comprised of: an insulator having an axial bore extending in the direction of an axis, a first inner circumferential surface extending at a forward side of the axial bore, a second inner circumferential surface extending at a rear side of the axial bore and having a diameter greater than that of the first inner circumferential surface, and a ledge connecting the first inner circumferential surface and the second inner circumferential surface; a center electrode having a head supported by the ledge and extending in a space surrounded by the second inner circumferential surface, and a circular columnar leg extending continuously from the forward end of the head in a space surrounded by the first inner circumferential surface; and a seal material for holding the center electrode in the axial bore.

8 Claims, 3 Drawing Sheets

(56) References Cited

U.S. PATENT DOCUMENTS

| | | | | |
|---|---|---|---|---|
| 2003/0038576 | A1* | 2/2003 | Matsutani et al. | 313/141 |
| 2005/0168121 | A1* | 8/2005 | Tinwell | 313/141 |

FOREIGN PATENT DOCUMENTS

| | | | |
|---|---|---|---|
| JP | 3497009 | 11/2003 | H01T 13/20 |
| JP | 2010-267425 | 11/2010 | H01T 13/34 |

* cited by examiner

SPARK PLUG

FIELD OF THE INVENTION

The present invention relates to a spark plug for providing ignition in an internal combustion engine, and more particularly to a spark plug in which a center electrode is fixed in good condition in an axial bore of an insulator.

BACKGROUND OF THE INVENTION

A spark plug for providing ignition in an internal combustion engine, such as an automobile engine, generally includes a tubular metallic shell and a tubular insulator disposed in a bore of the metallic shell. A center electrode is disposed at the forward side of an axial bore of the insulator, and a metal terminal is disposed at the rear side of the axial bore. A ground electrode has one end that is joined to the forward end of the metallic shell and another end facing the center electrode and forms a spark discharge gap in cooperation with the center electrode.

In recent years, there has been developed a technique for increasing driving distance with less fuel through improvement of output by use of a supercharger. In such an internal combustion engine, temperature within a combustion chamber tends to increase. As a result, the working environment of a spark plug is becoming more and more severe. When the spark plug is subjected to repeated temperature rise and drop (hereinafter, may be referred to as heating and cooling cycles) within the combustion chamber, the center electrode may become loose and have play in the axial bore of the insulator. Although the center electrode is fixed within the axial bore of the insulator by means of a seal material, as a result of subjection to repeated heating and cooling cycles, fixing strength between the center electrode and the seal material is apt to deteriorate.

Regarding such a problem, in order to enhance the strength of fixing the center electrode in the insulator, for example, claim 1 in Japanese Patent Application Laid-Open (kokai) No. 2010-267425 provides "a spark plug . . . characterized in that the head of the center electrode has grooves formed along its outer circumference."

Also, in order to ensure sufficient strength and impact resistance by means of a glass seal material, claim 1 in Japanese Patent No. 3497009 provides "a spark plug . . . characterized in that the diameter d0 of the large-diameter portion of the axial bore, the diameter d1 of the flange portion, and the diameter d2 of the head portion satisfy a relational expression $0 \leq d1-d2 \leq 1$ mm and that the flange-head length h from the forward end of the flange portion to the rear end of the head portion falls in a range of $2.0 \leq h \leq 3.0$ mm and in a range of ±25% of $(d0-d1) \times 5$."

An object of the present invention is to provide a spark plug having good adhesion between a center electrode and a seal material.

SUMMARY OF THE INVENTION

In accordance with the present invention, there is provided a spark plug comprising:

an insulator having an axial bore extending in a direction of an axis, a first inner circumferential surface extending at a forward side of the axial bore, a second inner circumferential surface extending at a rear side of the axial bore and having a diameter greater than that of the first inner circumferential surface, and a ledge connecting the first inner circumferential surface and the second inner circumferential surface;

a center electrode having a head supported by the ledge and extending in a space surrounded by the second inner circumferential surface, and a circular columnar leg extending continuously from a forward end of the head in a space surrounded by the first inner circumferential surface; and a seal material charged into a space surrounded by the ledge, the second inner circumferential surface, and the head to thereby hold the center electrode in the axial bore;

the spark plug being characterized in that:

assuming that a position P1 on the center electrode is where an outside diameter of the center electrode begins to increase, beyond an outside diameter H of the leg, from the leg toward a rear end of the center electrode, when an axial distance E along the axis from the position P1 to a forward end of the center electrode is 15 mm or more, an axial distance A along the axis from the position P1 to the rear end of the center electrode is 3.8 mm or more.

Preferred modes of the spark plug mentioned above in (1) are enumerated below.

(2) The outside diameter H is 1.7 mm or more.

(3) In the spark plug according to (1) or (2) mentioned above, the head has a large-diameter portion projecting radially outward and a protrusion protruding rearward from a rear end of the large-diameter portion, and a diameter B of an imaginary cylinder S1 which has such a minimum diameter as to be able to surround the protrusion is smaller than an outside diameter of the large-diameter portion and is 2 mm to 3.3 mm.

(4) In the spark plug according to any one of (1) to (3) mentioned above, the head has a large-diameter portion projecting radially outward and a protrusion protruding rearward from a rear end of the large-diameter portion, and, assuming that a position P2 on the center electrode is of a boundary between the large-diameter portion and the protrusion, an axial distance C along the axis between the position P2 and the position P1 is 0.5 mm to 3 mm.

(5) In the spark plug according to any one of (1) to (4) mentioned above, the axial distance A along the axis is 4 mm or more.

(6) In the spark plug according to any one of (1) to (5) mentioned above, an inside diameter F of the insulator as measured at the rear end of the center electrode is 3.5 mm or less.

(7) In the spark plug according to any one of (1) to (6) mentioned above, the axial distance A along the axis is 4.5 mm or more.

(8) In the spark plug according to any one of (1) to (7) mentioned above, the inside diameter F of the insulator as measured at the rear end of the center electrode is 2.9 mm or less.

The spark plug of the present invention is configured such that, when the axial distance E is 15 mm or more, the axial distance A is 3.8 mm or more, preferably 4.5 mm or more; therefore, the present invention can provide a spark plug having good adhesion between the center electrode and the seal material.

The spark plug of the present invention is configured such that the diameter B of the imaginary cylinder S1 is smaller than the outside diameter of the large-diameter portion and is 2 mm to 3.3 mm, and/or, the axial distance C is 0.5 mm to 3 mm; therefore, the present invention can provide a spark plug having far better adhesion between the center electrode and the seal member.

The spark plug of the present invention is configured such that, when the outside diameter H is 1.7 mm or more, and/or, the inside diameter F of the insulator is 3.5 mm or less, particularly 2.9 mm or less, effectiveness in adhesion between the center electrode and the seal material is particularly high.

DETAILED DESCRIPTION OF PREFERRED EMBODIMENTS

Figure 1:
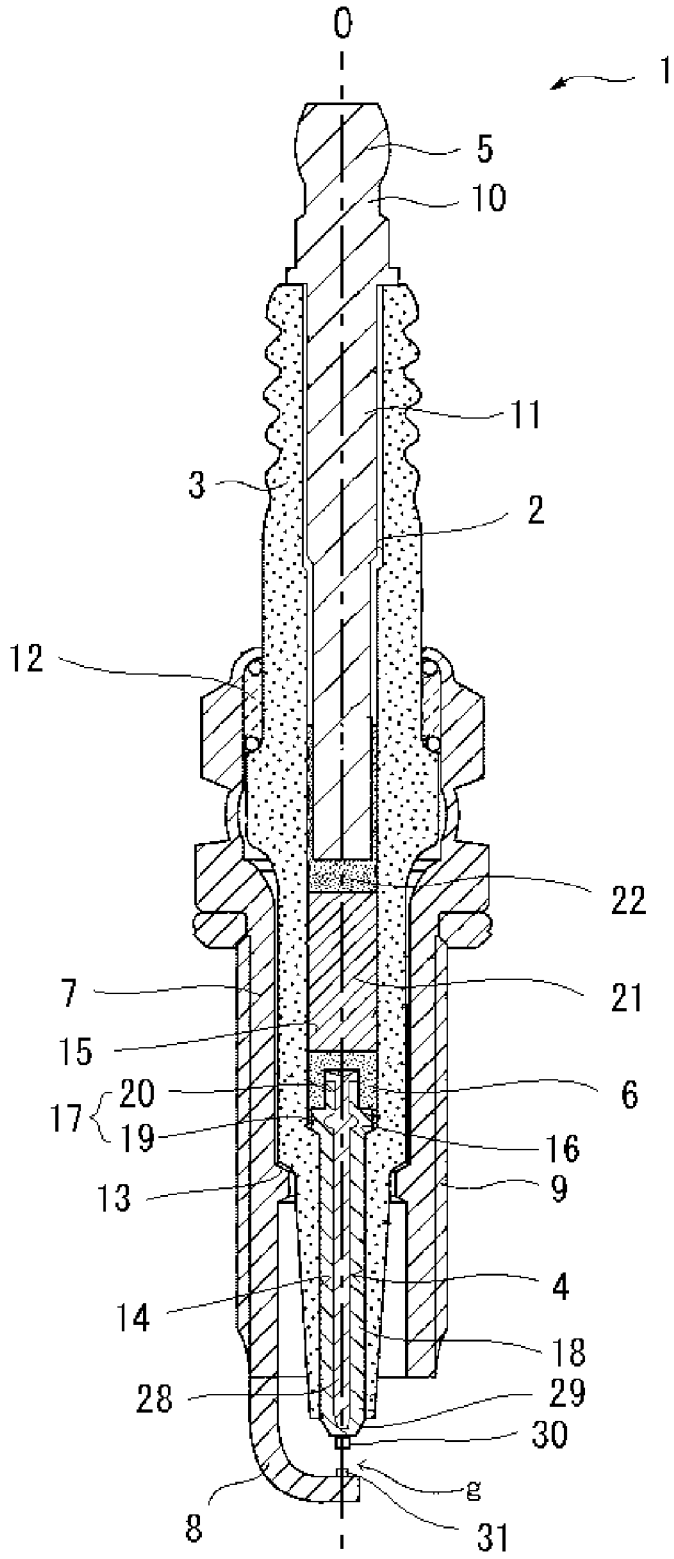
FIG. 1 is an overall explanatory view showing, in section, a spark plug which is one embodiment of the spark plug according to the present invention.

FIG. 1 shows a spark plug which is one embodiment of the spark plug according to the present invention. FIG. 1 is an overall explanatory view showing, in section, a spark plug 1 which is one embodiment of the spark plug according to the present invention. The axis of an insulator is denoted by the letter O, and, in the following description, the lower direction on the paper on which FIG. 1 appears is referred to as the forward direction along the axis O, and the upper direction on the paper is referred to as the rearward direction along the axis O.

The spark plug 1 includes the insulator 3 having an axial bore 2 extending in the direction of the axis O. A center electrode 4 is held by a seal material 6 at the forward side of the axial bore 2; and a metal terminal 5 is held at the rear side of the axial bore 2. A metallic shell 7 accommodates the insulator 3. A ground electrode 8 has one end that is joined to the forward end surface of the metallic shell 7 and another end that is disposed in such a manner as to face the center electrode 4 via a gap.

The metallic shell 7 has a substantially cylindrical shape and is formed in such a manner as to accommodate and hold the insulator 3. The metallic shell 7 has a threaded portion 9 formed on the outer circumferential surface of its forward portion. The spark plug 1 is dimensioned to be mounted to the cylinder head of an unillustrated internal combustion engine through utilization of the threaded portion 9. The metallic shell 7 can be formed from an electrically conductive steel material; for example, low-carbon steel. Preferably, in order to reduce the diameter of the spark plug 1, the threaded portion 9 has a size of M12 or less.

The ground electrode 8 assumes the form of, for example, a substantially rectangular columnar body. The shape and structure of the ground electrode 8 are designed as follows: one end of the ground electrode 8 is joined to the forward end surface of the metallic shell 7, and the body of the ground electrode 8 is bent at an intermediate position so as to assume a shape resembling the letter L and such that a distal end portion of the ground electrode 8 faces a forward end portion of the center electrode 4 via a gap. The ground electrode 8 is formed from a material similar to that used to form the center electrode 4.

The metal terminal 5 is adapted to apply, to the center electrode 4, voltage for performing spark discharge between the center electrode 4 and the ground electrode 8. The metal terminal 5 has a flange portion 10 which has an outside diameter greater than the diameter of the axial bore 2, projects outward from the axial bore 2, and is partially in contact with the rear end surface, with respect to the direction of the axis O, of the insulator 3. The metal terminal 5 further includes a substantially circular columnar rod portion 11 which extends forward from the forward end surface, with respect to the direction of the axis O, of the flange portion 10 and is accommodated in the axial bore 2. The metal terminal 5 is formed from, for example, low-carbon steel and has n Ni metal layer formed on its surface by plating or the like.

The insulator 3 is held by an inner circumferential portion of the metallic shell 7 via talc 12, a packing 13, etc. The insulator 3 has a first inner circumferential surface 14 extending at the forward side of the axial bore 2; a second inner circumferential surface 15 extending at the rear side of the axial bore 2 and having a diameter greater than that of the first inner circumferential surface 14; and a ledge 16 connecting the first inner circumferential surface 14 and the second inner circumferential surface 15. The insulator 3 is fixed to the metallic shell 7 in a state in which a forward end portion of the insulator 3 projects from the forward end surface of the metallic shell 7. Desirably, the insulator 3 is formed from a material having mechanical strength, thermal strength, electrical strength, etc. An example of such a material is a ceramic sintered body which predominantly contains alumina.

The center electrode 4 has a head 17 supported by the ledge 16 and extending in a space surrounded by the second inner circumferential surface 15; a circular columnar leg 18 extending continuously from the forward end of the head 17 in a space surrounded by the first inner circumferential surface 14; and a forward end portion 29 extending continuously from the forward end of the leg 18 in such a manner as to be reduced in outside diameter from that of the leg. The center electrode 4 is held in and electrically insulated from the metallic shell 7 in a state in which the forward end of the center electrode 4 projects from the forward end surface of the insulator 3. The head 17 has a large-diameter portion 19 projecting radially outward and a protrusion 20 protruding rearward from the rear end of the large-diameter portion 19. The forward end portion 29 projects from the forward end surface of the insulator 3 and has the form of a truncated cone. In the present embodiment, the entire forward end portion 29 projects from the forward end surface of the insulator 3; however, the forward end portion 29 may partially extend in a space surrounded by the first inner circumferential surface 14. Desirably, the center electrode 4 is formed from a material having thermal conductivity, mechanical strength, etc.; for example, the center electrode 4 is formed from a Ni-based alloy, such as INCONEL (trade name) 600. The center electrode 4 may have a core 28 enclosed by an outer layer 27 formed from a Ni-based alloy or the like. Core 28 is preferably formed from a material higher in thermal conductivity than the outer layer 27. Examples of a material used to form the core 28 include Cu, a Cu alloy, Ag, and an Ag alloy.

The seal material 6 is charged into a space surrounded by the ledge 16, the second inner circumferential surface 15, and the head 17, thereby holding the center electrode 4 in the axial bore 2. The seal material 6 can be formed by sintering a seal powder which contains a glass powder of soda borosilicate glass and a metal powder of Cu, Fe, or the like. The seal material 6 usually has a resistance of several hundred m Ω or less.

A resistor 21 is provided between the center electrode 4 and the metal terminal 5 via the seal material 6. The resistor 21 electrically connects the center electrode 4 and the metal terminal 5 and prevents generation of radio noise. The resistor 21 can be formed by sintering a resistor composition which contains a glass powder of soda borosilicate glass or the like, a ceramic powder of $ZrO_2$ or the like, an electrically-conductive nonmetal powder of carbon black or the like, and/or a metal powder of Zn, Sb, Sn, Ag, Ni, or the like. The resistor 21 usually has a resistance of 100 Ω or more.

In the present embodiment, a second seal material 22 formed from a composition similar to that used to form the seal material 6 is provided between the resistor 21 and the metal terminal 5, whereby the metal terminal 5 is fixed, in a sealed condition, to the insulator 3. The second seal material is provided as needed. In the case where the second seal material 22 is not provided, the metal terminal 5 is fixed, in a sealed condition, to the insulator 3 by means of the resistor 21.

Figure 2:
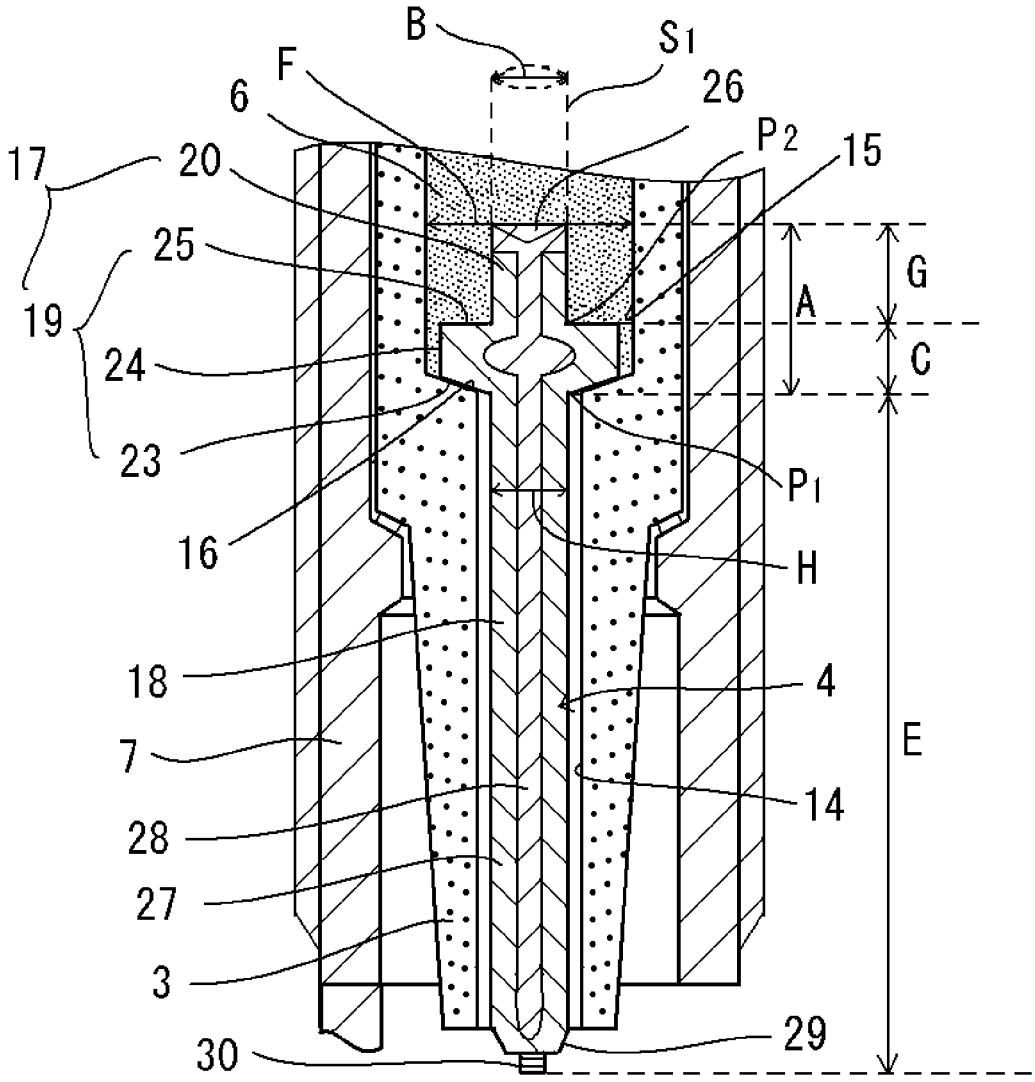
FIG. 2 is an explanatory view showing, in section, a main portion of the spark plug which is the embodiment of the spark plug of the present invention.

In this spark plug, assuming that, as shown in FIG. 2, a position P1 on the center electrode 4 is where the outside diameter of the center electrode 4 begins to increase, beyond an outside diameter H of the leg 18, from the leg 18 toward the rear end of the center electrode 4, when an axial distance E along the axis from the position P1 to the forward end of the center electrode 4 is 15 mm or more, an axial distance A along the axis O from the position P1 to the rear end of the center electrode 4 is 3.8 mm or more, preferably 4 mm or more, more preferably 4.5 mm or more.

When the spark plug is subjected to repeated temperature rise and drop in a combustion chamber, the following cycle is repeated: heat of spark discharge generated between the center electrode 4 and the ground electrode, heat within the combustion chamber, and the like are conducted from the forward end of the center electrode 4 to the head 17 disposed on a side toward the rear end of the center electrode 4, whereby the temperature of the head 17 of the center electrode 4 rises; subsequently, the head 17 stands to cool, whereby the temperature of the head 17 drops. When such a heating and cooling cycle is repeated, because of the difference in thermal expansion coefficient between a material used to form the center electrode 4 and a material used to form the seal material 6, pores are formed in the seal material 6 in a region in the vicinity of the interface between the head 17 and the seal material 6. In the spark plug, the more the heating and cooling cycle is repeated, and the greater the temperature difference, the greater the thermal expansion of the head 17, and the more likely the formation of pores. Also, cracking becomes more likely to occur between formed pores. Furthermore, since the operation of an internal combustion engine generates vibration, cracking becomes more likely to occur between formed pores; consequently, a larger void becomes more likely to occur.

However, when the axial distance A falls within the above-mentioned range, thermal expansion of the head 17 is reduced to thereby restrain formation of pores in the seal material 6, and occurrence of cracking between pores is restrained; therefore, there can be provided a spark plug having good adhesion between the center electrode 4 and the seal material 6. Even though such a spark plug is provided in a combustion chamber in which temperature rise and drop are repeated, and a temperature difference involved in temperature rise and drop is large, there is prevented occurrence of loosening and play of the center electrode 4 in the axial bore 2 of the insulator 3.

Even at the same temperature of a forward end portion of the center electrode 4, the temperature of the head 17 varies with the axial distance E, since the amount of heat conducted from the forward end portion to the head 17 varies. In the case of a short axial distance E of less than 15 mm, suppressing the temperature of the head 17 to a certain level or less fails; therefore, although the axial distance A is increased, the aforementioned effect fails to be yielded. By contrast, in the case of a long axial distance E of 15 mm or more, the aforementioned effect can be yielded by employing an axial distance A of 3.8 mm or more, preferably 4 mm or more, more preferably 4.5 mm or more.

In the case where a noble-metal tip 30 formed from a noble metal is provided at the forward end of the center electrode 4, the forward end of the noble-metal tip 30 is taken as the forward end of the center electrode 4. Therefore, in the case where the noble-metal tip 30 is provided, the axial distance E is an axial distance from the position P1 to the forward end of the noble-metal tip 30.

In the case of an axial distance A of 3.8 mm or less, since the temperature of the head 17 is apt to increase, thermal expansion of the head 17 is apt to increase, potentially resulting in formation of pores and occurrence of cracking in the seal material 6. Thus, adhesion between the center electrode 4 and the seal material 6 deteriorates. In the case of a long axial distance A, for example, in excess of 5 mm, since the distance between the position of generation of spark discharge and the position of the resistor 21 increases, the effect of restraining generation of radio noise may deteriorate. Therefore, preferably, the axial distance A is 5 mm or less.

The outside diameter H of the leg 18 can be measured, for example, as follows. First, a position located 1 mm rearward along the axis O from the forward end of the leg 18 is selected as the measurement start point, and, at the measurement start point, the diameters of the leg 18 are measured in two orthogonal directions. Similarly, the diameters in the two directions are measured at five points, including the measurement start point, located rearward at intervals of 1 mm from the measurement start position. The arithmetical mean of the thus-measured 10 diameters is calculated, thereby yielding the outside diameter H.

The position P1 is where the diameter of the center electrode 4 begins to increase, beyond the outside diameter H, rearward from the leg 18. In other words, the position P1 is the forward end position, with respect to the direction of the axis O, of a region which is located in the vicinity of the boundary between the leg 18 and the large-diameter portion 19 and whose outside diameter measured at any axial position is greater than the outside diameter H.

In the case of an outside diameter H of 1.7 mm or more, the effect yielded by the axial distance A being 3.8 mm or more is particularly high. In the case of an outside diameter H of 1.7 mm or more; i.e., the greater the diameter of the leg 18, the higher the rate of heat conduction in the rearward direction along the axis O from the forward end of the leg 18; thus, the increased temperature of the forward end of the leg 18 can be quickly lowered, and, therefore, an outside diameter H of 1.7 mm or more is preferred. Meanwhile, in the case of an outside diameter H of 1.7 mm or more, the temperature of the head 17 is apt to increase. Therefore, the aforementioned effect yielded by the axial distance A being 3.8 mm or more is high. Also, the leg 18 can assume any outside diameter so long as the leg 18 can be disposed in the axial bore 2, and the outside diameter H is usually 5 mm or less.

As shown in FIG. 2, the large-diameter portion 19 has, from the forward side to the rear side along the axis O, a diameter-expanding portion 23, a maximum diameter portion 24, and a diameter-reducing portion 25, and the protrusion 20 is provided continuously on the rear side of the diameter-reducing portion 25. The diameter-expanding portion 23 is supported by the ledge 16, and the center electrode 4 is fixed in the axial bore 2. In the present embodiment, the diameter-expanding portion 23 is formed into a tapered shape; the outer circumferential surface of the maximum diameter portion 24 is formed into a circular columnar (i.e., cylindrical) shape; and the diameter-reducing portion 25 is formed into a plane which is orthogonal to the axis O and connects the circular columnar maximum diameter portion 24 and the circular columnar protrusion 20 which is smaller in outside diameter than the maximum diameter portion 24.

In the present embodiment, the protrusion 20 is formed into a circular columnar (i.e., cylindrical) shape and has a conical recess 26 formed at its end located opposite the large-diameter portion 19. By virtue of formation of the recess 26, the area of contact between the seal material 6 and the head 17 increases, thereby facilitating adhesion between the seal material 6 and the head 17.

Figure 3A:
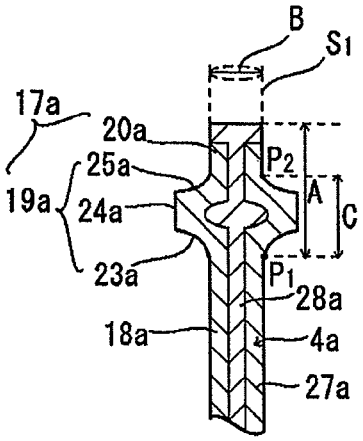
FIGS. 3(*a*) to 3(*c*) are explanatory views each showing, in section, a main portion of a center electrode which is one embodiment of the center electrode of the spark plug according to the present invention.
Figure 3B:
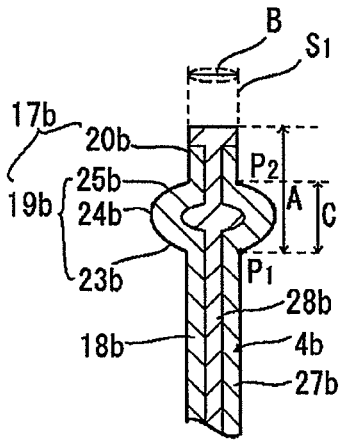
Figure 3:
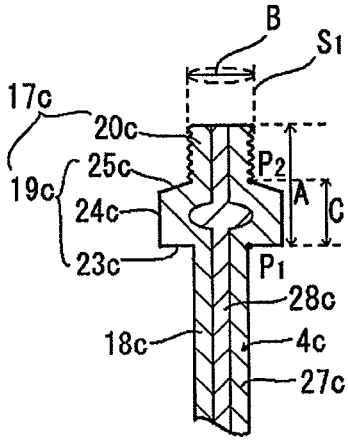

No particular limitation is imposed on the shape of the head 17 so long as the center electrode 4 is supported on the ledge 16 and fixed in the axial bore 2; for example, as shown in FIGS. 3(*a*)-3(*c*), various shapes can be employed for the head 17. For example, as shown in FIG. 3(*a*), the shape of a head 17*a* as viewed on the section of a center electrode 4*a* taken along the axis O is described, in terms of the contour of the head 17*a*, sequentially from the forward side of the center electrode 4*a*: a diameter-expanding portion 23*a* assumes the form of upward convex curves which continue from the respective rear ends of line segments parallel to the axis O and indicative of a leg 18*a*; a maximum diameter portion 24*a* assumes the form of line segments which are parallel to the axis O and continue from the respective rear ends of the curves of the diameter-expanding portion 23*a*; a diameter-reducing portion 25*a* assumes the form of downward convex curves which continue from the respective rear ends of the line segments of the maximum diameter portion 24*a*; and a protrusion 20*a* assumes the form of line segments which continue from the respective rear ends of the curves of the diameter-reducing portion 25*a* and are parallel to the axis O. The contour of a head portion 17*b* shown in FIG. 3(*b*) is as follows: a large-diameter portion 19*b* assumes the form of curves which continue from the respective rear ends of line segments parallel to the axis O and indicative of a leg 18*b* and are convex in directions orthogonal to the axis O; and a protrusion 20*b* assumes the form of line segments which continue from the respective rear ends of the curves of the large-diameter portion 19*b* and are parallel to the axis O similar to the case of FIG. 3(*a*). The contour of a head 17*c* shown in FIG. 3(*c*) is as follows: a diameter-expanding portion 23*c* assumes the form of line segments which continue from the respective rear ends of line segments parallel to the axis O and indicative of a leg 18*c* and are orthogonal to the line segments of the leg 18*c*; a maximum diameter portion 24*c* assumes the form of line segments parallel to the axis O and orthogonal to the line segments of the diameter-expanding portion 23*c*; a diameter-reducing portion 25*c* assumes the form of line segments which continue from the respective rear ends of the line segments of the maximum-diameter portion 24*c* and are inclined with respect to the axis O; and a protrusion 20*c* assumes the form of wavy lines which continue from the respective rear ends of the line segments of the diameter-reducing portion 25*c* and are substantially parallel to the axis O. The contour of the protrusion 20*c* assumes the form of wavy lines, since the surface of the protrusion 20*c* has undergone thread cutting or like working. Similar to the machined surface of the protrusion 20*c* in FIG. 3(*c*), the surfaces of the maximum diameter portions 24*a* to 24*c*, the surfaces of the diameter-reducing portions 25*a* to 25*c*, and the surfaces of the protrusions 20*a* to 20*c* may undergo thread cutting, knurling, or like working so as to have irregularities.

Preferably, the diameter B of an imaginary cylinder S1 which has such a minimum diameter as to be able to surround the protrusion 20 is smaller than the outside diameter of the large-diameter portion 19 and is 2 mm to 3.3 mm. The greater the outside diameter of the protrusion 20, the greater the volume of thermal expansion; meanwhile, the greater the outside diameter of the protrusion 20, the more likely the radiation of heat. Thus, in view of reduction in thermal expansion of the protrusion 20, preferably, the diameter B of the imaginary cylinder S1 falls within the aforementioned range. Therefore, when the diameter B of the imaginary cylinder S1 falls within the aforementioned range, there can be provided the spark plug 1 having far better adhesion between the center electrode 4 and the seal material 6.

Assuming that a position P2 on the center electrode 4 is of the boundary between the large-diameter portion 19 and the protrusion 20, preferably, an axial distance C along the axis O between the position P2 and the position P1; i.e., the axial distance C of the large-diameter portion 19, is 0.5 mm to 3 mm. The longer the axial distance C of the large-diameter portion 19 which is greater in outside diameter than the leg portion 18 and the protrusion 20, the greater the volume of thermal expansion; meanwhile, the longer the axial distance C, the more likely the radiation of heat. Thus, in view of reduction in thermal expansion of the large-diameter portion 19, preferably, the axial distance C falls within the aforementioned range. When the axial distance C falls within the aforementioned range, there can be provided the spark plug having far better adhesion between the center electrode 4 and the seal material 6.

The axial distance C is the axial distance between the position P1 and the position P2; the position P1 is stipulated as mentioned above; and the position P2 can be stipulated according to the shape of the center electrode 4 as follows. The position P2 is the boundary between the large-diameter portion 19 and the protrusion 20. In other words, the position P2 is a position which is located in the vicinity of the boundary between the large-diameter portion 19 and the protrusion 20 and where the outside diameter changes. As shown in FIG. 2 and FIGS. 3(*b*) and 3(*c*), in the case of an apparent change in the outside diameter, the position P2 is a position of a greatest change in the outside diameter in the vicinity of the boundary between the large-diameter portion 19 and the protrusion 20. Meanwhile, as shown in FIG. 3(*a*), in the case where a change in the outside diameter is not apparent in the vicinity of the boundary between the large-diameter portion 19 and the protrusion 20, the position P2 is a position which is located in the vicinity of the boundary between the large-diameter portion 19 and the protrusion 20 and where the outside diameter begins to increase, beyond the diameter B of the imaginary cylinder S1, along the forward direction of the axis O.

When the inside diameter F of the insulator 3 as measured at the rear end of the center electrode 4 is 3.5 mm or less, particularly 2.9 mm or less, the effect yielded by the axial distance A being 3.8 mm or more is particularly high. An inside diameter F of 3.5 mm or less, particularly 2.9 mm or less, is desirable under the following recent circumstances: in order to attain free engine design, a reduction in the size of an engine, etc., demand has been rising for development of a small-sized spark plug. On the other hand, when the inside diameter F is 3.5 mm or less, particularly 2.9 mm or less, pores are likely to be formed in the seal material 6 in fixing the center electrode 4 in the axial bore 2 in a sealed condition through charge of a seal powder, which is to become the seal material 6, into the axial bore 2 and subsequent application of heat and pressure, as will be described later, due to difficulty in compressing the seal material 6. Therefore, the effect yielded by the axial distance A being 3.8 mm or more is high.

The spark plug 1 is manufactured, for example, as follows. First, there are manufactured the center electrode 4, the ground electrode 8, the metallic shell 7, the metal terminal 5, and the insulator 3 having respectively predetermined shapes, by conventionally known methods. One end portion of the ground electrode 8 is joined to the forward end surface of the metallic shell 7 by laser welding or the like.

Meanwhile, the center electrode 4 is inserted into the axial bore 2 of the insulator 3; the diameter-expanding portion 23 of the center electrode 4 is seated on the ledge 16 of the axial bore 2; and the leg 18 is disposed in a space surrounded by the first inner circumferential surface 15, and the head 17 is disposed in a space surrounded by the second inner circumferential surface.

Next, a seal powder used to form the seal material 6, a resistor composition used to form the resistor 21, and a seal powder used to form the second seal material 22 are charged, in this order, into the axial bore 2 from the rear end of the axial bore 2. A press pin is then inserted into the axial bore 2 and applies a pressure of 60 $N/mm^2$ or more for preliminary compression.

Next, the rod portion 11 of the metal terminal 5 is inserted into the axial bore 2 from the rear end of the axial bore 2, and the metal terminal 5 is disposed such that the rod portion 11 is in contact with the seal powder.

Next, while the seal powders and the resistor composition are heated at a temperature equal to or higher than the glass softening point of glass powders contained in the seal powders; for example, at a temperature of 800° C. to 1,000° C., for 3 minutes to 30 minutes, the rod portion 11 of the metal terminal 5 is inserted under pressure until the forward end surface of the flange portion 10 of the metal terminal 5 comes into contact with the rear end surface of the insulator 3, thereby compression-heating the seal powders and the resistor composition.

In this manner, the resistor 21, the seal material 6, and the second seal material 22 are formed through sintering of the seal powders and the resistor composition, and the seal material 6 and the second seal material 22 fix the center electrode 4 and the metal terminal 5, respectively, in the axial bore 2 in a sealed condition. At this time, because of difference in thermal expansion coefficient between the center electrode 4 and the seal material 6, a plurality of pores are formed in the seal material 6 in a region in the vicinity of the interface between the center electrode 4 and the seal material 6.

Next, the insulator 3 to which the center electrode 4, the metal terminal 5, etc., are fixed is attached to the metallic shell 7 to which the ground electrode 8 is joined.

Finally, a distal end portion of the ground electrode 8 is bent toward the center electrode 4 such that one end of the ground electrode 8 faces a forward end portion of the center electrode 4, thereby completing the spark plug 1.

The spark plug according to the present invention is used as an ignition plug for an internal combustion engine of an automobile, such as a gasoline engine, as follows: the threaded portion of the spark plug is threadingly engaged with a threaded hole provided in a head (not shown) which dividingly forms combustion chambers of the internal combustion engine, whereby the spark plug is fixed at a predetermined position. The spark plug according to the present invention can be used in any type of internal combustion engine; however, the spark plug is particularly effective when used with a combustion chamber having high inside temperature.

The spark plug according to the present invention is not limited to the above-described embodiment, but may be modified in various other forms, so long as the object of the present invention can be achieved. For example, the spark plug according to the present invention can exhibit good adhesion between the center electrode and the seal material, irrespective of thread diameter, by complying with the aforementioned requirements.

In the spark plug 1 of the embodiment described above, the core 28 is exposed at the rear end surface and at the outer circumferential surface of a rear end portion of the center electrode 4. However, the core 28 may be exposed only at the rear end surface of the center electrode 4, or the core 28 may be entirely covered with the outer layer 27 without any exposure. The spark plug according to the present invention can exhibit good adhesion between the center electrode and the seal material, irrespective of state of exposure of the core, by complying with the aforementioned requirements.

The noble metal tips 30 and 31 formed from a platinum alloy, an iridium alloy, or the like may be provided on the opposed surfaces of the center electrode 4 and the ground electrode 8, respectively. Alternatively, the noble metal tip may be provided on only either one of the center electrode 4 and the ground electrode 8. In the spark plug 1 of the present embodiment, the noble metal tips 30 and 31 are provided on the center electrode 4 and the ground electrode 8, respectively, and a spark discharge gap g is formed between the noble metal tips 30 and 31.

EXAMPLES

Manufacture of Spark Plugs

Spark plugs having a shape similar to that of the spark plug shown in FIG. 1 were manufactured by the aforementioned manufacturing process. Spark plugs having various dimensions shown in Table 1 were manufactured by varying the inside diameter (F) of the insulator, the axial distance (A) from the position P1 to the rear end of the center electrode, the diameter (B) of the imaginary cylinder S1 having such a minimum diameter as to be able to surround the protrusion, the axial distance (C) between the position P1 and the position P2, the axial distance (E) from the position P1 to the forward end of the center electrode, the axial distance (G) from the position P2 to the rear end of the center electrode, and the average outside diameter (H) of the leg.

The various dimensions were measured as follows. The dimension (F) was measured on a fluoroscopic image captured by use of a micro CT scanner (TOSCANER), a product of TOSHIBA. The dimensions (A), (B), (C), (E), (G), and (H) were measured as follows: the center electrodes were removed from the spark plugs, the center electrodes were measured for the dimensions by use of a projector. The dimension (H) was measured as mentioned above; specifically, a position located 1 mm rearward along the axis from the forward end of the circular columnar leg was selected as the measurement start point. Diameters of the leg in two directions were measured at five points, including the measurement start point, located rearward at intervals of 1 mm from the measurement start position; and the dimension (H) was calculated from the measured diameters. The dimension (B) was obtained by measuring the maximum diameter of the protrusion of each of the center electrodes.

The spark plug of test No. 12 in Table 1 (below) had the shape of the center electrode similar to that shown in FIG. 1 except that thread cutting was performed on the surface of the protrusion of the center electrode. The spark plug of test No. 13 in Table 1 had the shape of the center electrode similar to that shown in FIG. 1 except that the protrusion of the center electrode had a shape machined by use of a three-pawl chuck. The protrusions having these shapes were measured for the dimension (B) as follows: the image of each of the protrusions was captured from a direction orthogonal to the axis of the center electrode by use of a projector, and the maximum width of the protrusion along a radial direction was measured. The center electrode was then rotated by 60°, and the maximum width of the protrusion was measured; and, similarly, a total of six maximum widths were measured by rotating the center electrode 60° by 60°, and the greatest value of these maximum widths was taken as the dimension (B).

Each of the center electrodes had a core formed from a metal which contained Cu as a main component, and an outer layer which enclosed the core and was formed from a metal which contained Ni as a main component, and the thickness of the outer layer as measured at the position P2 was 0.4 mm.

Evaluation Method (Impact Resistance Test)

The thus-manufactured spark plugs were tested as follows: there was repeated a cycle consisting of applying heat with a burner so as to raise the temperature of a forward end portion of the center electrode to 800° C., conducting the impact test in compliance with Sect. 7.4 of JIS B8031, and allowing to cool. Upon completion of each cycle, the resistance of the resistor of each of the spark plugs was measured. When the $R_1/R_0$ value became 0.6 or less, the test was terminated, where $R_0$ is resistance measured at 12 V, and $R_1$ is resistance measured at 3 kV. On the basis of the number of cycles upon termination of the test, adhesion between the center electrode and the seal material was evaluated. Criteria for evaluation are shown below. Table 1 shows the results of the test.

1: less than one cycle

2: one cycle to less than two cycles 3 to 8: two cycles or more; addition of one point per cycle 9: nine cycles to less than 10 cycles 10: 10 cycles or more

TABLE 1

| | | Insulator Center electrode | | | | | | | Evaluation |
|---|---|---|---|---|---|---|---|---|---|
| Test No. | | F (mm) | A (mm) | B (mm) | C (mm) | E (mm) | G (mm) | H (mm) | results |
| 1 | Comp. ex. | 4.0 | 3.5 | 2.9 | 1.2 | 17 | 2.3 | 2.0 | 3 |
| 2 | | 4.0 | 3.5 | 2.9 | 1.2 | 15 | 2.3 | 2.0 | 2 |
| 3 | Example | 4.0 | 3.8 | 2.9 | 1.2 | 15 | 2.6 | 2.0 | 6 |
| 4 | Comp. ex. | 4.0 | 3.5 | 2.9 | 1.2 | 14 | 2.3 | 2.0 | 1 |
| 5 | | 4.0 | 3.8 | 2.9 | 1.2 | 14 | 2.6 | 2.0 | 2 |
| 6 | | 4.0 | 3.5 | 2.9 | 1.2 | 17 | 2.3 | 1.7 | 3 |
| 7 | | 4.0 | 3.5 | 2.9 | 1.2 | 17 | 2.3 | 1.5 | 4 |
| 8 | Example | 4.0 | 3.8 | 2.9 | 1.2 | 17 | 2.6 | 1.7 | 7 |
| 9 | | 4.0 | 3.8 | 2.9 | 1.2 | 17 | 2.6 | 1.5 | 8 |
| 10 | Comp. ex. | 3.5 | 3.5 | 2.3 | 1.2 | 17 | 2.3 | 2.0 | 1 |
| 11 | | 3.0 | 3.5 | 2.3 | 1.2 | 17 | 2.3 | 2.0 | 1 |
| 12 | | 3.5 | 3.5 | 2.3 | 1.2 | 17 | 2.3 | 2.0 | 2 |
| 13 | Example | 4.0 | 3.8 | 2.9 | 1.2 | 17 | 2.6 | 2.0 | 6 |
| 14 | | 3.5 | 3.8 | 2.3 | 1.2 | 17 | 2.6 | 2.0 | 6 |
| 15 | | 4.0 | 4.0 | 2.9 | 1.2 | 17 | 2.8 | 2.0 | 9 |
| 16 | | 4.0 | 4.0 | 2 | 1.2 | 17 | 2.8 | 2.0 | 9 |
| 17 | | 4.0 | 4.0 | 3.3 | 1.2 | 17 | 2.8 | 2.0 | 9 |
| 18 | | 4.0 | 4.0 | 1.8 | 1.2 | 17 | 2.8 | 2.0 | 8 |
| 19 | | 4.0 | 4.0 | 3.5 | 1.2 | 17 | 2.8 | 2.0 | 8 |
| 20 | | 4.0 | 4.0 | 2.9 | 1.2 | 28 | 2.8 | 2.0 | 10 |
| 21 | | 4.0 | 4.0 | 2.9 | 1.0 | 17 | 3.0 | 2.0 | 9 |
| 22 | | 4.0 | 4.0 | 2.9 | 0.5 | 17 | 3.5 | 2.0 | 9 |
| 23 | | 4.0 | 4.0 | 2.9 | 3.0 | 17 | 1.0 | 2.0 | 9 |
| 24 | | 4.0 | 4.0 | 2.9 | 3.5 | 17 | 0.5 | 2.0 | 8 |
| 25 | | 3.5 | 4.0 | 2.3 | 1.2 | 17 | 2.8 | 2.0 | 9 |
| 26 | | 3.5 | 4.0 | 1.8 | 1.2 | 17 | 2.8 | 2.0 | 8 |
| 27 | | 3.0 | 4.0 | 2.3 | 1.2 | 17 | 2.8 | 2.0 | 9 |
| 28 | | 3.0 | 4.0 | 1.8 | 1.2 | 17 | 2.8 | 2.0 | 8 |
| 29 | | 4.0 | 4.5 | 2.9 | 1.2 | 17 | 3.3 | 2.0 | 9 |
| 30 | | 3.5 | 4.5 | 2.3 | 1.2 | 17 | 3.3 | 2.0 | 9 |
| 31 | | 3.0 | 4.5 | 2.3 | 1.2 | 17 | 3.3 | 2.0 | 9 |
| 32 | | 4.0 | 4.0 | 2.9 | 1.2 | 17 | 2.8 | 3.0 | 9 |
| 33 | Comp. ex. | 2.9 | 3.5 | 2.2 | 1.2 | 17 | 2.3 | 2.0 | 1 |
| 34 | Example | 2.9 | 3.8 | 2.2 | 1.2 | 17 | 2.6 | 2.0 | 7 |
| 35 | | 2.9 | 4.0 | 2.2 | 1.2 | 17 | 2.8 | 2.0 | 8 |
| 36 | | 2.9 | 4.5 | 2.2 | 1.2 | 17 | 3.3 | 2.0 | 10 |
| 37 | Comp. ex. | 2.5 | 3.5 | 2.0 | 1.2 | 17 | 2.3 | 2.0 | 1 |
| 38 | Example | 2.5 | 3.8 | 2.0 | 1.2 | 17 | 2.6 | 2.0 | 7 |
| 39 | | 2.5 | 4.0 | 2.0 | 1.2 | 17 | 2.8 | 2.0 | 8 |
| 40 | | 2.5 | 4.5 | 2.0 | 1.2 | 17 | 3.3 | 2.0 | 10 |

The spark plugs of test Nos. 41 to 52 were tested in a manner similar to that for the spark plugs of test Nos. 1 to 40 except that heat was applied with the burner so as to raise the temperature of the forward end portion of the center electrode to 850° C. Table 2 shows the results of the test.

TABLE 2

| | | Insulator Center electrode | | | | | | | Evaluation |
|---|---|---|---|---|---|---|---|---|---|
| Test No. | | F (mm) | A (mm) | B (mm) | C (mm) | E (mm) | G (mm) | H (mm) | results |
| 41 | Comp. ex. | 4.0 | 3.5 | 2.9 | 1.2 | 18 | 2.3 | 2.6 | 1 |
| 42 | Example | 4.0 | 4.0 | 2.9 | 1.2 | 18 | 2.8 | 2.6 | 6 |
| 43 | | 4.0 | 4.5 | 2.9 | 1.2 | 18 | 3.3 | 2.6 | 8 |

TABLE 2-continued

| Test No. | | Insulator Center electrode F (mm) | A (mm) | B (mm) | C (mm) | E (mm) | G (mm) | H (mm) | Evaluation results |
|---|---|---|---|---|---|---|---|---|---|
| 44 | | 4.0 | 5.0 | 2.9 | 1.2 | 18 | 3.8 | 2.6 | 8 |
| 45 | Comp. ex. | 2.9 | 3.5 | 1.2 | 1.2 | 18 | 2.3 | 2.6 | 1 |
| 46 | Example | 2.9 | 4.0 | 2.2 | 1.2 | 18 | 2.8 | 2.6 | 5 |
| 47 | | 2.9 | 4.5 | 1.2 | 1.2 | 18 | 3.3 | 2.6 | 8 |
| 48 | | 2.9 | 5.0 | 2.2 | 1.2 | 18 | 3.8 | 2.6 | 8 |
| 49 | Comp. ex. | 2.5 | 3.5 | 2 | 1.2 | 18 | 2.3 | 2.6 | 1 |
| 50 | Example | 2.5 | 4.0 | 2 | 1.2 | 18 | 2.8 | 2.6 | 5 |
| 51 | | 2.5 | 4.5 | 2 | 1.2 | 18 | 3.3 | 2.6 | 8 |
| 52 | | 2.5 | 5.0 | 2 | 1.2 | 18 | 3.8 | 2.6 | 8 |

As shown in Tables 1 and 2, in spite of repeated heating and cooling cycles, the spark plugs embraced in the scope of the present invention exhibited good adhesion between the center electrode and the seal material and were unlikely to increase in resistance.

DESCRIPTION OF REFERENCE NUMERALS

1: spark plug
2: axial bore
3: insulator
4: center electrode
5: metal terminal
6: seal material
7: metallic shell
8: ground electrode
9: threaded portion
10: flange portion
11: rod portion
12: talc
13: packing
14: first inner circumferential surface
15: second inner circumferential surface
16: ledge
17: head
18: leg
19: large-diameter portion
20: protrusion
21: resistor
22: second seal material
23: diameter-expanding portion
24: maximum diameter portion
25: diameter-reducing portion
26: recess
27: outer layer
28: core
29: forward end portion
30, 31: noble metal tip

The invention claimed is:

1. A spark plug comprising:

an insulator having an axial bore extending in a direction of an axis, said axial bore having a first inner circumferential surface extending at a forward side of the axial bore, a second inner circumferential surface extending at a rear side of the axial bore and having a diameter greater than that of the first inner circumferential surface, and a ledge connecting the first inner circumferential surface and the second inner circumferential surface;

a center electrode having a head supported by the ledge and extending in a space surrounded by the second inner circumferential surface, and a cylindrical columnar leg extending continuously from a forward end of the head in a space surrounded by the first inner circumferential surface of said insulator; and a seal material charged into a space surrounded by the ledge, the second inner circumferential surface, and the head to thereby hold the center electrode in the axial bore;

wherein, assuming a position P1, P1 is a position on the center electrode where an outside diameter of the center electrode begins to increase, beyond an outside diameter H of the leg, from the leg toward a rear end of the center electrode, when an axial distance E along the axis from the position P1 to a forward end of the center electrode is 15 mm or more, an axial distance A along the axis from the position P1 to the rear end of the center electrode is 3.8 mm or more.

2. A spark plug according to claim 1, wherein the average outside diameter H is 1.7 min or more.

3. A spark plug according to claim 1, wherein the head has a large-diameter portion projecting radially outward and a protrusion protruding rearward from a rear end of the large-diameter portion, and a diameter B of an imaginary cylinder S1 which has such a minimum diameter as to be able to surround the protrusion is smaller than an outside diameter of the large-diameter portion and is 2 mm to 3.3 mm.

4. A spark plug according to claim 1, wherein, the head has a large-diameter portion projecting radially outward and a protrusion protruding rearward from a rear end of the large-diameter portion, and assuming that a position P2 on the center electrode is of a boundary between the large-diameter portion and the protrusion, an axial distance C along the axis between the position P2 and the position P1 is 0.5 mm to 3 mm.

5. A spark plug according to claim 1, wherein an inside diameter F of the insulator as measured at the rear end of the center electrode is 3.5 mm or less.

6. A spark plug according to claim 1, wherein the axial distance A along the axis is 4.5 mm or more.

7. A spark plug according to claim 1, wherein the inside diameter F of the insulator as measured at the rear end of the center electrode is 2.9 mm or less.

8. A spark plug comprising:

an insulator having an axial bore extending in a direction of an axis, said axial bore having a first inner circumferential surface extending at a forward side of the axial bore, a second inner circumferential surface extending at a rear side of the axial bore and having a diameter greater than that of the first inner circumferential surface, and a ledge connecting the first inner circumferential surface and the second inner circumferential surface;

a center electrode having a head supported by the ledge and extending in a space surrounded by the second inner circumferential surface, and a cylindrical columnar leg extending continuously from a forward end of the head in a space surrounded by the first inner circumferential surface of said insulator; and a seal material charged into a space surrounded by the ledge, the second inner circumferential surface, and the head to thereby hold the center electrode in the axial bore;

wherein, assuming a position P1, P1 is a position on the center electrode where an outside diameter of the center electrode begins to increase, beyond an outside diameter H of the leg, from the leg toward a rear end of the center electrode, when an axial distance E along the axis from the position P1 to a forward end of the center electrode is 15 mm or more, an axial distance A along the axis from the position P1 to the rear end of the center electrode is 4 mm or more.

* * * * *